United States Patent [19]

Banks

[11] Patent Number: 4,830,247

[45] Date of Patent: May 16, 1989

[54] BELT-SUSPENDED HOLSTER FOR CAULKING GUN

[76] Inventor: Steve Banks, Route 4, Riverside Rd., Lancaster County, S.C. 29720

[21] Appl. No.: 37,711

[22] Filed: Apr. 13, 1987

[51] Int. Cl.[4] ..... B67B 7/24; A45F 5/00

[52] U.S. Cl. ..... 224/252; 224/904; 224/197; 224/247; 211/70.6; 222/82; 30/123

[58] Field of Search ..... 224/251, 252, 253, 255, 224/904, 197, 200, 232, 242, 246, 247, 249, 269; D8/14.1; 222/80, 81, 82, 175, 389, 390, 391; 30/123, 124; 7/105, 157, 158; 211/170, 70.6; 269/131, 254

[56] References Cited

U.S. PATENT DOCUMENTS

| | | | |
|---|---|---|---|
| 969,524 | 9/1910 | Condon | 224/253 X |
| 1,403,707 | 1/1922 | Quarnstrom | 224/247 X |
| 1,464,659 | 8/1923 | Keely | 224/247 |
| 1,518,092 | 12/1924 | Meegan | 224/252 X |
| 1,605,195 | 11/1926 | Lewis | 224/197 X |
| 2,985,349 | 5/1961 | McGuire | 224/247 X |
| 3,497,118 | 2/1970 | Majjar | 224/249 X |
| 3,501,074 | 3/1970 | Emerick | 224/246 X |
| 3,637,120 | 1/1972 | Clay | 224/246 |
| 3,977,582 | 8/1976 | McMahon | 222/246 |
| 4,077,595 | 3/1978 | Carter et al. | 248/210 |
| 4,106,679 | 8/1978 | Hillinger | 224/197 |
| 4,135,644 | 1/1979 | Pacetti | 222/81 |
| 4,214,688 | 7/1980 | Griffin, Jr. | 224/197 |
| 4,493,437 | 1/1985 | Breeden | 222/82 |

FOREIGN PATENT DOCUMENTS

| | | | |
|---|---|---|---|
| 1007991 | 5/1952 | France | 224/247 |
| 1077958 | 11/1954 | France . | |
| 250232 | 5/1948 | Switzerland . | |

*Primary Examiner*—Henry J. Recla
*Assistant Examiner*—Ernest G. Cusick

[57] ABSTRACT

A holster for a caulking gun is supported from the belt of a user by a suspension configuration at an end of the holster. The opposite end of the holster is provided with a nose plate for receiving the applicator tip of the caulking gun. The holster is further provided with a clasp to retain the caulking gun. Further, the holster may support a cutting element and wire element for use in opening the caulking gun.

17 Claims, 1 Drawing Sheet

BELT-SUSPENDED HOLSTER FOR CAULKING GUN

The present invention is, in general, a belt-suspended holder for tools and, more specifically, is a holster for holding caulking guns therein, although the improvements are not limited thereto.

BACKGROUND OF THE INVENTION

Many tools are used under conditions which make it inconvenient for the user to keep them in hand or to set them aside when they are not actually in use. The well-known caulking gun is one of these. In addition, the dripping of caulking compound from the tool during non-use represents a problem because it so easily can wind up on the hands or clothes of the user, or on the floor where it becomes a safety hazard to others, and can be tracked to other locations.

Apparently, little has been done to alleviate this problem. Of course, there are many belt-suspended holders for tools in general, but few, if any, address the special problems posed by caulking guns. However, it is instructive to examine the solutions developed for holding other tools.

Martin Swiss Pat. No. 250,232, published May 18, 1948, discloses a belt from which are suspended, by loops, a number of sheaths into which are inserted various kinds of materials and tools. Except for illustrating the concept of suspension by loops from a belt, Martin has no bearing on the present invention.

Henrion French Pat. No. 1,077,958, published Nov. 15, 1954, discloses a sheath or scabbard having a protective tip thereon, for suspending files or the like slim pointed objects from a belt, and providing for the tip to be fastened to a wearer's thigh. Except for the protective tip to cover the points, Henrion has no bearing on the present invention.

Gliebe U.S. Pat. No. 3,021,101, issued Feb. 13, 1962, discloses a holder for a fishing rod, said holder being held on a belt by a sheath. Gliebe's only relationship to the present invention is to disclose a sheath suspended from a belt.

Breeding et al U.S. Pat. No. 3,343,735, issued Sept. 26, 1967, discloses a holster for a mason's trowel, designed to be adaptable to a range of sizes thereof. Other than being a holster to suspend a tool from a belt, it has no relationship to the present invention.

Rosenkaimer U.S. Pat. No. 4,114,787, issued Sept. 19, 1978, discloses a scabbard for a knife which can be attached to a belt without unfastening the belt. Other than disclosing one method of removably attaching a belt clip over a belt, there is no relationship to the present invention.

Pattermann U.S. Pat. No. 4,300,708, issued Nov. 17, 1981, discloses a scabbard or sheath for a drywall taper's knife. Pattermann has no relationship to the present invention.

Tuthill U.S. Pat. No. 4,496,088, issued Jan. 29, 1985, discloses a sportsman's sheath for holding a pair of pliers and a knife. There is no relationship to the present invention.

Litman U.S. Pat. No. 4,588,116, issued May 13, 1986, discloses a holster for holding a tear-gas projector on the belt. Other than disclosing a receptacle for holding the projector, there is no relationship to the present invention.

The only relationships to the present invention which are disclosed in the foregoing references are those which are old in the art, and which do not anticipate or suggest, either singly or in combination, the novel improvements of the present invention.

BRIEF DESCRIPTION OF THE PRESENT INVENTION

The present invention is a "holster" for a caulking "gun", which is comprised of a strap suspended from a belt and having a first end and a second end. A clip is attached to the first end for removably attaching said strap to a belt, and a nose plate is attached to the second end of the strap for receiving the applicator tip of the gun. One or more C-clasps are attached to the strap between the belt clip and the nose plate. One of the benefits and objectives of the invention is that it frees the user's hands to perform other tasks except when actually engaged in caulking.

In use, the tip of the caulking gun is inserted into the nose plate, and the body or tube of the gun is moved sideways into the C-clasps, clamping it thereto. The nose plate can include a tube which encases the applicator tip of the gun, so that caulking compound is not dripped on undesired surfaces.

The holster can also include a retainer means, such as a safety strap, for securing the caulking gun to the holster, to prevent it from accidentally being dislodged from the holster and falling.

The caulking gun holster is preferably hinged between the belt clip and the upper C-clasp, so that it can pivot forward or backward when the user is crouching or kneeling, and the applicator tip could come in contact with the floor or ground.

Further, the holster can incorporate means for holding a blade for cutting the caulking tip, and a length of wire for punching a hole in the tube of caulking compound so that it can be extruded therefrom.

Other benefits and objectives will become apparent as the detailed description and the drawings are studied.

DETAILED DESCRIPTION OF THE PRESENT INVENTION

Figures 1, 2, 3:
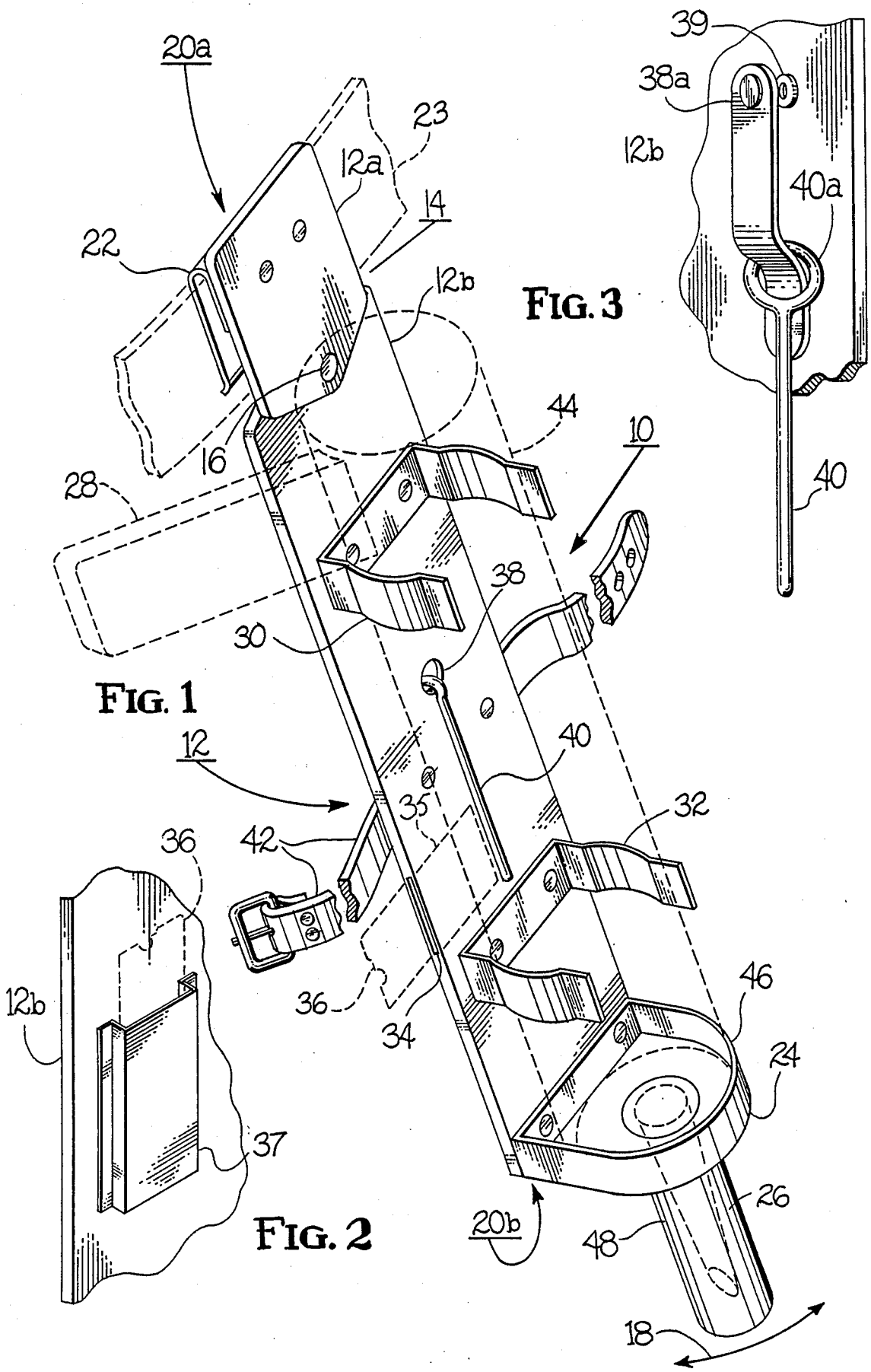
FIG. 1 is an isometric view of the present invention, with a caulking gun shown in dotted outline mounted therein.
FIG. 2 is a view of a segment of the elongated strap member disclosing an alternate embodiment of a first holder means for holding a blade.
FIG. 3 is a view of a segment of the elongated strap member disclosing an alternate embodiment of a second holder means for holding a length of wire thereon.

FIG. 1 discloses present invention 10, which comprises elongated strap member 12, preferably composed of segments **12*a* and 12*b*, pivoted at 14 by rivet 16, so that segment 12*b* can pivotally move with respect to segment 12*a*, as shown by arrows 18, and as hereinafter explained more fully. Belt suspension means 22 is attached to first end 20*a* of strap 12, and nose plate 24 is attached to second end 20*b* thereof. Applicator tip 26 associated with caulking gun 28, shown in dotted outline mounted in holster 10, extends through nose plate 24 into tip guard 48. Clasp 30 is attached transversely to strap segment 12*b* between rivet 16 and nose plate 24. Another clasp 32 can also be attached to strap 12*b***, if needed, as hereinafter explained more fully.

Holster 10 preferably includes first holder means 34 for holding blade 36, second holder means 39 for holding wire 40, and retainer means 42, all as hereinafter explained more fully.

The use of holster 10 is as follows: belt suspension means 22 is fastened over the user's belt 23. Strap 12 then hangs down alongside the user's leg. Applicator tip 26 of caulking gun 28 is inserted through nose plate 32, and tube 44, which contains the caulking compound, is snapped sideways into clasp 30. If the user will be working above other persons, retainer means 42, which can be a strap including a buckle thereon, can be fastened around tube 44 during periods of non-use, to prevent gun 28 from becoming dislodged from holster 10 and posing a threat to those below.

When it is desired to use caulking gun 28, retainer means 42 is first loosened, if fastened, and gun 28 is tilted outwardly, removing tube 44 from clasp 30. Applicator tip 26 is then withdrawn from nose plate 24, removing gun 28 from holster 10. Blade 36 is removed from first holder means 34 and is used to remove the closed end of applicator tip 26. As is well known to those skilled in the art, the amount of applicator tip 26 which is removed determines the amount of caulking compound which will be extruded by operation of gun 28 and applied to the working surface. Blade 36 is then replaced in holder means 34. Wire 40 is removed from second holder means 39, and is inserted into the hole in applicator tip 26 to rupture a membrane in the end of tube 44 so that caulking compound can be extruded therefrom through applicator tip 26 onto the work surface.

It will be seen by those skilled in the art that the pivoted structure of strap 12 permits a user to move the holster 10 forward or backward when kneeling or crouching, to prevent it from contacting the ground, floor or the like.

Strap 12 can be fabricated of any of several materials, for example, leather, imitation leather, stout canvas, plastic, etc., as long as it is durable and capable of being fabricated in the form described.

Belt suspension means 22 can be any type of clip or grip that firmly, releasably engages a belt 23.

Pivot 16 can be any of several types of fasteners that permit two pieces of strap material to be fastened together firmly but pivotally.

Clasp 30 and 32 are shown as well known C-clasps, but can be any convenient means of removably attaching tube 28 or gun 26 to strap 12.

Nose plate 24 can include a circumferential rim 46 and tip guard 48 mounted thereon, as disclosed, or it can be a simple C-shaped plate against which the end of tube 44 abuts, with tip 26 extending therethrough. Of course, this latter configuration would give no protection against dripping of compound.

Caulking gun 26 can be fastened to strap **12*b* by retainer means 42, in the form of a safety strap having a buckle thereon, as shown in FIG. 1, or by some other means, such as a cuff with VELCRO fastening on the edges thereof, which can be wrapped around strap 12b and tube 28**.

First holder means 34 for blade 36 can take any of several forms, such as a cavity 35, entered through slot 34, and fabricated into the edge of strap 12, or a receptacle 37 fastened thereto at a convenient point as disclosed in FIG. 2.

Second holder means 39 can be any of several appropriate means to removably fasten wire 40 to strap 12. For example, wire 40 can have a simple hook formed in the end thereof, which is inserted into hole 38 in strap 12 and suspended from the edge thereof, as shown. Or, wire 40 can have a loop **40*a* formed in the end thereof, which is then placed over a flap 38*a* secured to strap 12*a*, with mating fasteners 39 and 39*a* thereon as disclosed in FIG. 3**.

It will be apparent to those skilled in the art that many modifications in form and structure could be made in the present invention without departing from the spirit or intent thereof.

The terms and expressions which have been employed in the foregoing specification are used therein as terms of description and not of limitation, and there is no intention, in the use of such terms and expressions, of excluding equivalents of the features shown and described, or portions thereof, it being recognized that the scope of the invention is defined and limited only by the claims which follow.

What I claim as my invention is:

1. A holster for a caulking gun having an applicator tip associated therewith, comprising:

a. an elongated strap member having a first end and a second end, and having mounted thereon:

1. belt suspension means at said first end thereof for suspending a caulking gun holster from a belt;
2. a nose plate at said second end thereof for receiving an applicator tip associated with a caulking gun; and
3. a clasp located between said belt suspension means and said nose plate for retaining a caulking gun.

2. The holster of claim 1, wherein said elongated strap member comprises two segments, pivotally hinged to each other.

3. the holster of claim 2, wherein said two segments are pivotally hinged intermediate said belt suspension means and said clasp.

4. The holster of claim 1, 2 or 3 wherein said elongated strap member has mounted thereon retainer means for retaining said gun thereby, intermediate said clasp and said nose plate adapted for retaining a caulking gun.

5. The holster of claim 1, 2 or 3 having therein first holder means for holding a blade.

6. The holster of claim 5, wherein said first holder means is a cavity in said elongated strap member.

7. The holster of claim 5, wherein said first holder means is a receptacle affixed to said elongated strap member.

8. The holster of claim 1, 2 or 3 having thereon second holder means for holding a length of wire having an end thereon.

9. The holster of claim 8, wherein said second holder means includes an aperture having an edge in said elongated strap member, said length of wire includes hook means fabricated on said end, said hook means being inserted in said aperture and engaging said edge thereof.

10. The holster of claim 8, wherein said second holder means includes flap means affixed to said elongated strap member and having a first fastener means thereon, said elongated member having a second fastener means thereon, said length of wire having a loop in said end thereof for placing over said flap means, and said first fastener means thereafter being engaged with said second fastener means.

11. A caulking gun holster, comprising:

a. an elongated strap member having a first end and a second end, and having mounted thereon:
   1. a belt suspension means at said first end thereof for suspending a caulking gun holster from a belt;
   2. a nose plate at said second end thereof; and
   3. a clasp located between said suspension means and said nose plate;

b. said elongated member including:
   1. first holder means for holding a blade; and
   2. second holder means for holding a length of wire;
   3. a retainer for fastening a caulking gun thereto; and c. said elongated member being divided into two segments pivotally movable with respect to each other.

12. The holster of claim 11, wherein said two segments are pivoted intermediate said suspension means and said clasp.

13. The holster of claim 11, wherein said caulking gun has an applicator tip associated therewith, and said nose plate includes a circumferential rim and a receptacle for receiving said applicator tip therein.

14. The holster of claim 11, wherein said first holder means includes a cavity in said elongated strap member.

15. The holster of claim 13, wherein said first holder means is a receptacle affixed to said elongated strap member.

16. The holster of claim 14 or 15, wherein said second holder means includes an aperture having an edge in said elongated member for holding said length of wire, and said length of wire having an end thereon, and including a hook fabricated in said end thereof, said hook being inserted in said aperture and engaging said edge thereof.

17. The holster of claim 14 or 15, wherein said second holder means includes a flap affixed to said elongated member and having a first fastener thereon, said elongated member having a second fastener thereon, said length of wire having an end thereon with a loop fabricated therein for placing over said flap, and said first fastener thereafter being engaged with said second fastener.

* * * * *